United States Patent [19]

Buss et al.

[11] 3,962,750

[45] June 15, 1976

[54] HINGE CONSTRUCTION

[75] Inventors: Kenton A. Buss, Oxford; Tony E. Branscum, Winfield, both of Kans.

[73] Assignee: Gott Manufacturing Co., Inc., Winfield, Kans.

[22] Filed: Apr. 7, 1975

[21] Appl. No.: 565,408

[52] U.S. Cl. ..... 16/168; 220/342

[51] Int. Cl.[2] ..... E05D 5/10

[58] Field of Search ..... 220/342, 343, 347, 337; 16/168, 169, 128 R, 134, 156, 163–165, 173, 176, 183, DIG. 13

[56] References Cited

UNITED STATES PATENTS

| | | | |
|---|---|---|---|
| 1,270,076 | 6/1918 | Waitt | 16/169 |
| 1,540,581 | 6/1925 | Way | 16/168 X |

*Primary Examiner*—G. V. Larkin

*Attorney, Agent, or Firm*—Lowe, Kokjer, Kircher, Wharton & Bowman

[57] ABSTRACT

Hinge construction for joining two relatively movable members. The hinge is particularly adapted for construction from plastics using known molding techniques and for incorporation into plastic molded parts. Identical hinge halves are formed to present, in each half, a planar mounting portion and a hinge tube section. The planar mounting portion is characterized by a peripheral tongue which is received within a peripheral groove of a socket in the respective member. The hinge tube section of each hinge half has opposed protuberances at one end which extend part way along the length of the section and into the tubular opening. When two hinge halves are placed with their tube sections aligned, the latter form a tubular hinge opening. A hinge pin is provided with opposed grooves which are complemental to the protuberances and disposed for alignment with the latter. The hinge pin may thus be inserted into the tubular hinge opening and held therein upon rotation to a nonaligning position.

8 Claims, 5 Drawing Figures

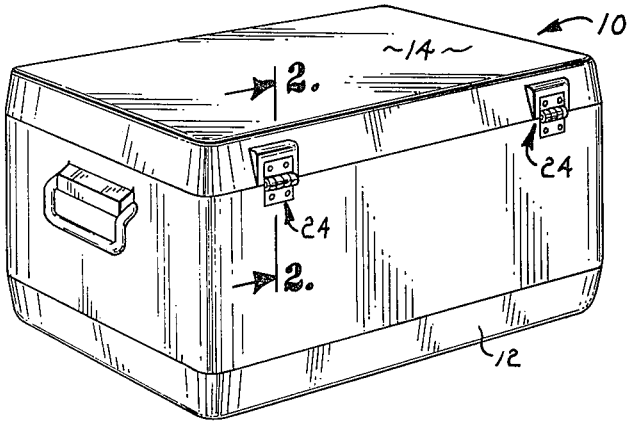
Fig. 1.
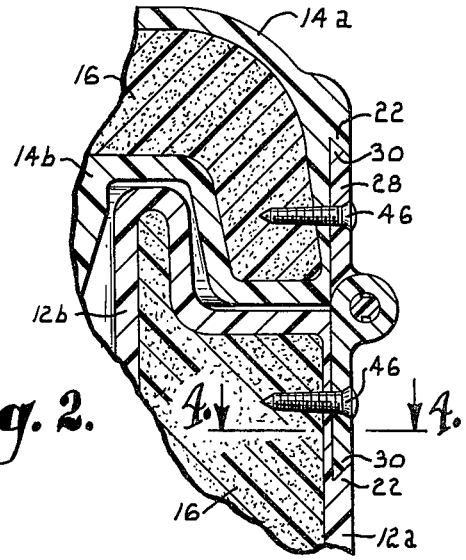
Fig. 2.
Fig. 3.
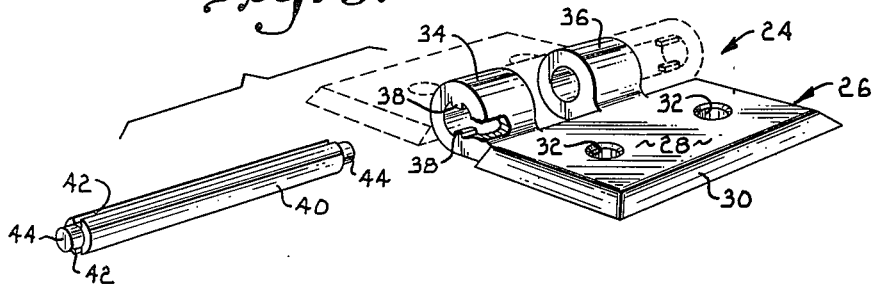
Fig. 4.
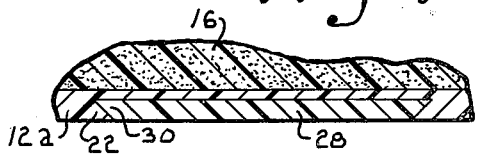
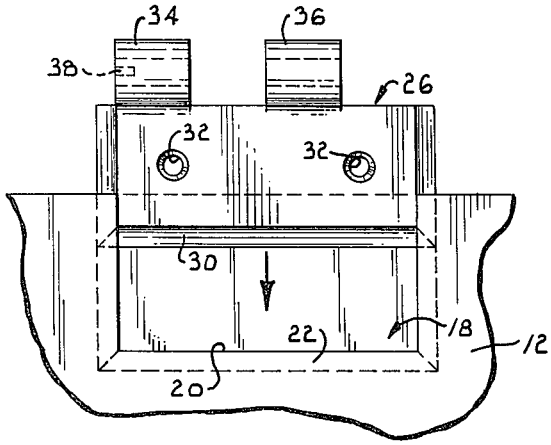
Fig. 5.

HINGE CONSTRUCTION

This invention relates to hinge constructions.

The provision of hinges for plastic articles has heretofore been a particular problem. Many types of hinge constructions have been utilized with various attendant problems. In some instances, plastic hinge constructions are particularly subject to breakage upon repeated usage. When stronger hinge constructions are attempted, problems are often encountered in molding and assemblage. In all cases, plastic hinges which are formed as a part of plastic articles have heretofore been irreplaceable in the event of breakage, thus often attributing to consumer resistance to the article itself.

It is accordingly a primary object of the present invention to provide a hinge construction which is particularly adapted for use with plastic articles.

Another objective of the invention is to provide a hinge construction for plastic articles which may be utilized in conjunction with known molding techniques to form the hinge as an integral part of the article or which may be formed separately and incorporated into the article after the latter is formed.

As a corollary to the above objective, an aim of the invention is to provide a hinge construction for plastic articles which is easy to assemble after the article to be hinged has been formed.

It is also an important aim of the invention to provide a hinge construction wherein a molded hinge may be easily assembled with a molded article to be hinged and wherein various techniques for fastening the hinge to the article may be utilized.

Still another object of this invention is to provide a molded hinge for use with plastic articles wherein removable auxiliary fasteners may be utilized to secure the hinge to the article so as to make the hinge replaceable in the event of breakage.

Another aim of the invention is to provide a plastic hinge construction with identical hinge halves so as to permit molding of the two halves in a simple mold cavity.

A very important objective of the invention is to provide a hinge construction for plastic articles which may be molded as an integral part of the article or secured to the latter with auxiliary fasteners and in the latter case to provide structure apart from the auxiliary fasteners for carrying the weight placed on the hinge thus substantially eliminating the danger of the auxiliary fasteners pulling loose from the article itself.

Other objects of the invention will be made clear or become apparent from the following description and claims when read in light of the accompanying drawing wherein:

FIG. 1 is a perspective view of a container having a hinged lid and incorporating the hinge construction of the present invention;

FIG. 2 is a greatly enlarged vertical, cross-sectional view taken along line 2—2 of FIG. 1;

FIG. 3 is another enlarged exploded perspective view of the hinge construction;

FIG. 4 is a horizontal, cross-sectional view taken along line 4—4 of FIG. 2; and FIG. 5 is a side elevational view illustrating the manner in which one of the hinge halves is inserted into a socket on one of the members to be hinged.

Referring initially to FIG. 1, an insulated container is designated generally by the numeral 10 and comprises a body member 12 and a lid member 14. Container 10 may be formed using various known construction techniques although the invention is particularly adapted for use with a container formed by known molding techniques with a double wall construction indicated by the numerals 12*a*, 12*b* and 14*a* and 14*b* in FIG. 2. A layer 16 of foam insulation is placed between the walls of both the body member and the lid member.

Each of the members 12 and 14 is provided with two spaced-apart hinge sockets designated generally by the numeral 18 in FIG. 5. Since each of the sockets 18 is identical, only one will be described in detail. The socket 18 shown in FIG. 5 comprises a polygonal pocket formed in the side of body member 12 with a peripheral groove 20 presented around three sides of the socket by an integral projecting extension 22 of sidewall 12*a*. Extension 22 overlaps the pocket opening as a result of the generally V-shaped cross-sectional configuration of the extension 22 and the integral adjacent section of sidewall 12*a* (see FIG. 2). The side of socket 18 adjacent the terminal edge of body member 12 is free of extension 22 for purposes to be made clear hereinafter.

Referring now additionally to FIG. 3, the hinge construction of the present invention is designated generally by the numeral 24. Included in the hinge construction are first and second hinge halves designated generally by the numeral 26. Each of the hinge halves is identical and hence only one will be described in detail. Hinge half 26 comprises a generally planar, polygonally configured hinge mounting portion 28 which is complemental in configuration to the configuration of socket 18 previously described. Mounting portion 28 is characterized by a peripheral tongue 30 which extends around three sides of portion 28. Tongue 30 is of generally V-shaped cross-sectional configuration as best illustrated in FIG. 2. Apertures 32 are provided in portion 28 for receiving auxiliary fasteners as will be explained more fully hereinafter.

Along the side of mounting portion 28 which is free of tongue 32 extends a hinge tube section comprised of two tubular hinge barrel components 34 and 36. Hinge tube component 34 is provided with opposed protuberances 38 at one end which extend a short distance along the length of component 34 and also project into the tubular opening a short distance.

A hinge pin 40 has an outside diameter approximately equal to the internal diameter of the hinge opening presented by components 34 and 36. Hinge pin 40 is also provided with opposed longitudinally extending slots 42 which are generally complemental in configuration to the configuration of protuberances 38. At each end of hinge pin 40 is an extension 44 of reduced diameter adapted to be received between the protuberances 38 when the hinge pin is positioned within the hinge opening.

The hinge construction of the present invention is particularly adapted for use with plastic formed articles and can be easily assembled with an article such as container 10 after the latter has been formed. To this end, each hinge halve 26 is slid into its respective socket 18 in the manner illustrated in FIG. 5. Tongue 30 is designed to frictionally engage the extension 22 which presents peripheral groove 20. Since each hinge half is identical, a single assembly station can be utilized without any danger of placing the wrong part in the wrong socket.

With the hinge halves in their respective sockets, the two members to be hinged are brought together and the components 34 and 36 are aligned so as to present a tubular hinge opening for receiving pin 40. Again, since both hinge halves are identical, pin 40 may be inserted from either end of the tubular hinge opening. Slots 42 are aligned with protuberances 38 and the pin is pushed into the tubular opening until extensions 44 are received between protuberances 38. Since the outer surface of hinge pin 40 will be in frictional engagement with the inner surface of the tubular hinge opening presented by the aligned hinge tube components, a slight pivotal movement of the two hinged members will cause a misalignment between slots 42 and protuberances 38. This effectively locks the hinge pin within the tubular hinge opening. During normal use, it is not practical that slots 42 would ever again become aligned with protuberances 38 for a long enough period of time for the hinge pin to work free from the tubular hinge opening.

Auxiliary fasteners such as screws 46 may be inserted through apertures 32 in mounting portion 28 to hold the hinge halves in place. It is to be understood, however, that in large part the forces applied to hinge 24 will be carried by socket 18 thus minimizing any loosening effect on screws 46. It is contemplated that in some applications screws 46 will not even be used or that alternative fasteners such as rivets or spot welds could replace screws 46. Alternatively, tongue 30 and wall extension 22 could be permanently joined through adhesion or some form of cohesive bonding. The hinge construction 24 may also be utilized where the article to be hinged is formed integrally around the hinge halves as the article itself is formed.

While the invention has been described with particular reference to a container 10 of the type normally used to contain food or beverages, it is to be understood that the invention is intended to be utilized with any type or form of article where two members are designed for relative pivotal movement. The invention has particular application with hinged articles formed from plastic material.

What we claim is:

1. Hinge construction comprising:

a first hinge half presenting a generally planar mounting portion and an integral first hinge tube section, said first hinge tube section presenting a protuberance extending from one end of said section into the tubular opening along a portion of the length of said section;

a second hinge half presenting a generally planar mounting portion and an integral second hinge tube section, said second hinge tube section presenting a protuberance extending from one end of said section into the tubular opening along a portion of the length of said section;

said first and second hinge halves being adapted to be disposed in mating relationship with said first and second hinge tube sections being aligned to present a tubular hinge opening with said protuberances at opposite ends of the opening; and a hinge pin having a longitudinally extending slot disposed therein generally complemental in configuration to the shape of said protuberances whereby said pin may be inserted within said tubular hinge opening when said slot is aligned with the protuberance at one end of said opening and held therein upon rotation to a nonaligning position to cooperate with said first and second hinge halves to present a hinge.

2. The invention of claim 1, wherein each of said first and second hinge tube sections presents first and second opposed protuberances extending from one end of the section into the tubular opening, and said hinge pin has opposed longitudinally extending slots generally complemental to said protuberances and disposed for alignment with the latter.

3. The invention of claim 2, wherein said hinge pin is provided with an extension of reduced diameter at each end, each of said extensions adapted to be received between said protuberances of each of said hinge tube sections when said pin is inserted in said tubular hinge opening.

4. The invention of claim 3, wherein each of said first and second hinge tube sections comprises first and second spaced apart hinge tube components.

5. The invention of claim 1, wherein said hinge construction is adapted for coupling first and second members in hinged relationship, each of said members having a socket along the edge to be hinged with a peripheral groove extending at least part way around the socket and wherein each of said planar mounting portions of said first and second hinge halves respectively is complemental in configuration to the socket in a respective member and is characterized by a peripheral tongue adapted to be received in the peripheral groove.

6. The invention of claim 6, wherein each of said sockets and each of said planar mounting portions is of generally polygonal configuration.

7. The invention of claim 6, wherein one side of each of said sockets is free of said peripheral groove to allow each of said planar mounting portions to be slid into its respective socket.

8. The invention of claim 7, wherein is included auxiliary fastening means for securing each of said planar mounting portions to the respective members.

* * * * *